United States Patent [19]

Averbuch et al.

[11] 4,215,741

[45] Aug. 5, 1980

[54] HEAT EXCHANGER

[76] Inventors: Martin P. Averbuch, 166-25 Powells Cove Blvd., Beechhurst, N.Y. 11357; Jack A. Averbuch, 768 Jefferson St., Baldwin, N.Y. 11510

[21] Appl. No.: 930,608

[22] Filed: Aug. 3, 1978

[51] Int. Cl.[3] ..... G05D 23/00; F28F 7/00

[52] U.S. Cl. ..... 165/11 R; 165/DIG. 12; 165/78; 165/95; 122/20 B

[58] Field of Search ..... 165/DIG. 2, DIG. 12, 165/76, 78, 32, 11, 5, 95; 122/20 B

[56] References Cited

U.S. PATENT DOCUMENTS

| | | | |
|---|---|---|---|
| 2,615,687 | 10/1952 | Simmons | 165/78 |
| 2,882,023 | 4/1959 | Rizzo | 165/DIG. 2 |
| 3,412,786 | 11/1968 | Taylor | 165/5 |
| 3,734,171 | 5/1973 | Ares et al. | 165/76 X |
| 4,043,014 | 8/1977 | Wilson | 122/20 B X |
| 4,078,602 | 3/1978 | Richer | 165/32 |
| 4,138,969 | 2/1979 | Thompson et al. | 165/78 X |

*Primary Examiner*—Albert W. Davis
*Assistant Examiner*—Margaret A. Focarino
*Attorney, Agent, or Firm*—Bauer & Amer

[57] ABSTRACT

A heat exchanger operatively arranged, like a sliding drawer in a dresser, to be urged through opposite direction sliding movement to facilitate its positioning at and removal in relation to a heat exchange station within a flue, or the like, of a heating system, with the result that it is readily easy to service and maintain the unit clear of soot and other clogging materials. Since, as noted, the problems associated with clogging are significantly obviated, the heat exchanger, among other advantages, can embody in its construction closely spaced heat exchange fins to greatly enhance the amount of heat extracted from the exiting flue gases.

1 Claim, 5 Drawing Figures

HEAT EXCHANGER

The present invention relates generally to constructions of heat exchangers, of the type in which water circulating through conduits and exiting flue or combustion gases are passed in heat exchange relation with each other, and more particularly to an improved construction for such heat exchanger that contributes to the efficiency of the heat exchange operation thereof, while maintaining a desirable compact or minimum size in the unit.

As understood, an exchange of heat, as from exiting hot flue or combustion gases of a boiler-operated heating system to lower temperature water destined for supplementary heating or other end uses, is increased by prolonging the time duration in which the gases and circulating water are in heat exchange proximity with each other. Thus, as exemplified by the heat exchanger of U.S. Pat. No. 1,885,267, baffles are advantageously used to cause several heat exchange passes of the gas past the water or, to the same effect, and as exemplified by U.S. Pat. No. 4,043,014, the circulating water is pumped through multiple coils of a helical conduit operatively arranged in the path of the flue gases. While the foregoing are effective, space requirements of a typical flue gas conduit, among other considerations, may not be conducive to using these and similar solutions. A solution, more preferable, is to benefit from the increase of the heat exchange surface of the circulating water, but not by a comparatively large helically coiled conduit length, but by attaching heat exchange fins therealong. Heretofore, however, adjacently spaced heat exchange fins were vulnerable to being clogged by soot or similar content in the exiting flue gas, and thus could not be effectively used in practice.

Broadly, it is an object of the present invention to provide an improved heat exchanger overcoming the foregoing and other shortcomings of the prior art. Specifically, it is an object to provide a compactly sized heat exchanger that is readily positioned and removed from its operative location in heat exchange relation to the rising flue gases, and thus correspondingly readily cleaned or otherwise serviced on an appropriately frequent basis so that clogging of the gas passages therethrough is effectively obviated. As a consequence, the area of heat exchange surface, by way of closely spaced heat exchange fins or otherwise, can be of an optimum large extent, without any interference with the performance of the heat exchanger because of clogging or the like.

Demonstrating objects and advantages of the present invention is a heat exchanger adapted for facilitated positioning and removal in relation to a heat exchange station preparatory to extracting heat from combustion gases during the exiting flow thereof through an exit conduit. In a preferred embodiment, the heat exchanger includes four vertically oriented walls operatively arranged in facing relation to each other to define an open rectangular frame of a selected size in excess of the exit conduit of the flue or combustion gases, said excess size contributing to unimpeded movement through the frame of the combustion gases. A sinuous arrangement of water-circulation conduits is disposed in spanning relation between an opposing two of the frame walls so as to position these conduits transversely across the flow path of the combustion gases. Advantageously completing the heat exchanger construction are movement-guiding surfaces extending laterally along opposite edges of each vertical wall for establishing contact with cooperating surfaces of the combustion gas exit conduit. As a result, the heat exchanger is adapted to be urged through opposite direction sliding movement while supported by the established contact of the referred to cooperating surfaces, to thereby contribute to its facilitated positioning at and removal in relation to the heat exchange station.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 3 is a top plan view thereof;

FIG. 4 is a front elevational view, in section taken along line 4—4 of FIG. 3, illustrating the water-circulation conduits of the heat exchanger and the heat exchange fins thereof; and FIG. 5 is a perspective view illustrating further structural details of the heat exchanger per se.

Figure 2:
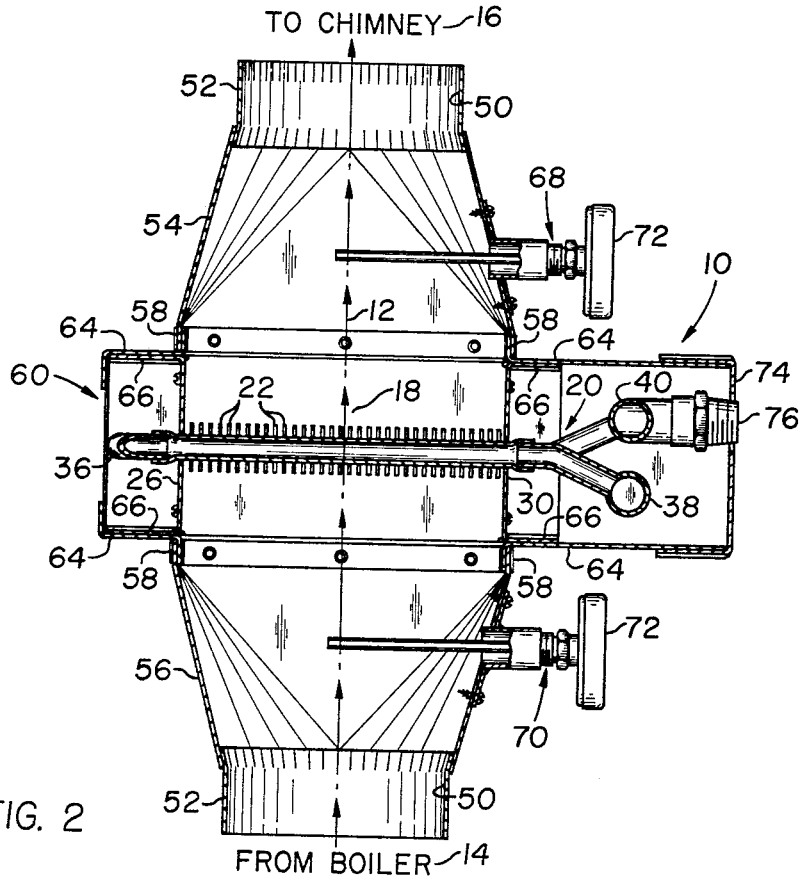
FIG. 2 is a side elevational view, in section taken along line 2—2 of FIG. 1, illustrating further structural features.

As is perhaps best denoted in FIG. 2, the improved heat exchanger hereof, generally designated 10, is advantageously used as an integrated part of a building heating system. In this contemplated end use, the utility of the heat exchanger 10 is to extract heat from flue or combustion gases that otherwise would be lost as a result of these gases rising along flow path 12 from a heat source, such as boiler 14, and exiting to atmosphere through a chimney or the like 16. Thus, the combustion gases 12 are advantageously passed in heat exchange relation, as at heat exchange station 18, with the heat exchanger 10, and more particularly with the sinuous arrangement of water-circulation conduits 20 of said heat exchanger. It is contemplated as a result that a significant amount of the heat from the rising combustion gases 12 will transfer to, and thus raise the temperature of, the water circulating through the conduit 20 to thereby enhance its subsequent use in a hot water or heating system for the building that houses the construction depicted in the drawings.

What has been thus far generally depicted is known, being shown for example in U.S. Pat. No. 4,043,014 and other such patents involving systems for extracting heat from flue gases and the like to pre-heat water or otherwise recover heat that otherwise would be lost. What is not known, and what therefore represents the within inventive contribution, is the novel and noteworthy manner in which the heat exchanger 10 is readily positioned and removed in relation to the heat exchange station 18, and thus in heat exchange relation to the rising combustion or flue gases 12. Moreover, as a result of being readily positioned and removed from the heat exchange station 18, in a manner which will be described in detail subsequently, it is possible, and therefore contemplated in accordance with the present invention, to operatively arrange on the water-circulation conduits 20 a series of spaced apart heat exchange fins, individually and collectively designated 22. These fins 22, in a well understood manner, extract, by heat exchange, heat from the rising flue gases 12, and thereby supplement the recovered heat that is effectively transferred to the water being circulated through the conduits 20. In an optimum arrangement, adjacent fins 22 are spaced as close as ⅜ of an inch without adverse effect on the heating system by impeding flow of the rising combustion gases 12. Ordinarily, fins spaced at such a nominal distance as ⅜ of an inch from each other soon become clogged with soot and other materials resulting from incomplete combustion of the gases 12. However, because the heat exchanger 10 is so readily removed and then re-positioned at the heat exchange station 18, there is no particular problem in frequently removing the heat exchanger 10 for cleaning and removal of any materials that would tend to clog the spaces between the fins 22. Naturally, the schedule for periodic cleaning of the heat exchanger 10 would depend on the particular combustion material being used in the boiler 14, and thus the content of the gases 12 resulting from the combustion thereof.

Figure 3:
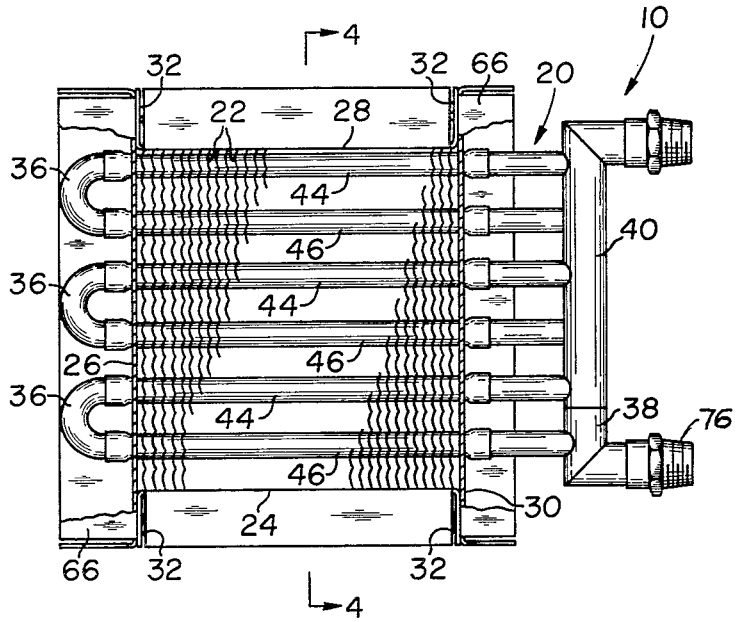
FIGS. 3, 4 and 5 are various views of the heat exchanger per se. More particularly.
Figure 4:
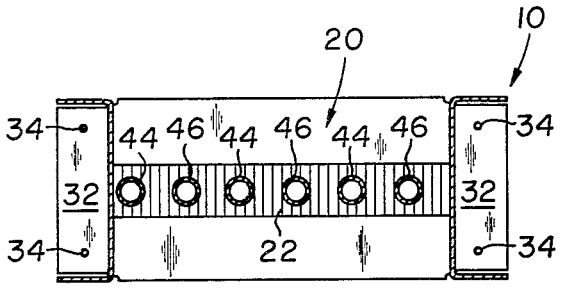
Figure 5:
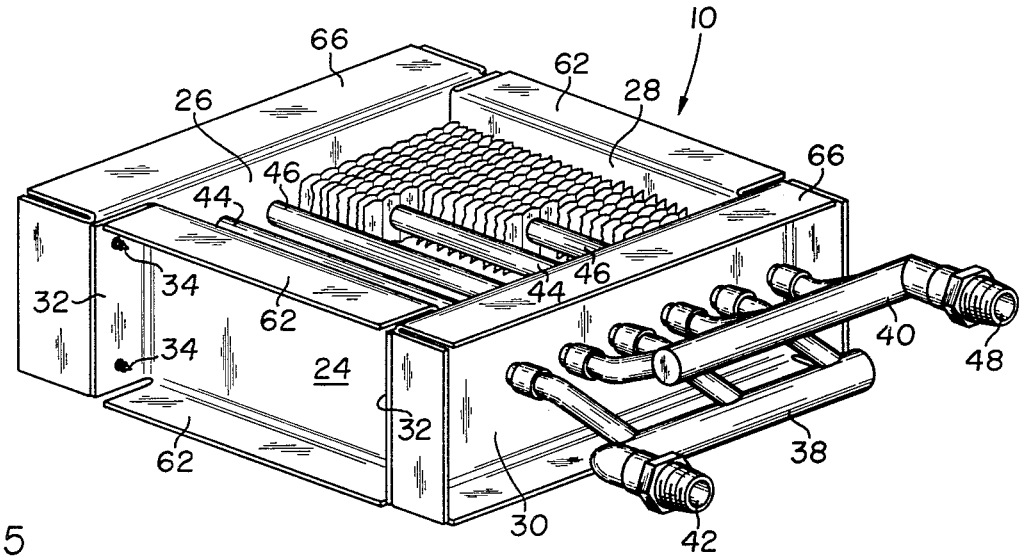

With the aforesaid understanding of the environment in which it is contemplated using the heat exchanger 10, reference should be made to the illustrations thereof, in isolated perspective, as set forth in FIGS. 3, 4 and 5. In a preferred form, heat exchanger 10 includes four vertically oriented walls 24, 26, 28 and 30 arranged in facing relation to each other so as to define a rectangular frame. At opposite ends of the side walls 24 and 28, there are laterally extending flanges 32 which overlap end portions of the end walls 26 and 30 and which thus provide locations at which the walls are conveniently connected to each other, as by bolts 34.

In the rigid frame which is formed of the walls 24, 26, 28 and 30, in the manner as just described, the previously referred to water-circulation conduits, and more particularly the sinuous arrangement 20 thereof, is supported by spanning relation between the front and rear walls 30, 26 for the entire width of the frame, said width extending from the one side wall 24 to the other side wall 28.

As best shown in FIG. 3, alternate straight length portions of the conduit 20 are connected together by end pipe fixtures 36, while the opposite ends are connected to two horizontally oriented pipe fixtures 38 and 40. Assuming that pipe 38 is the inlet, the heat exchange fluid or water in practice is admitted through the inlet opening 42 into pipe 38, through which it is then distributed through the pipe length portions more particularly designated 44 in FIG. 4. Said water is then reversed in direction through the end pieces 36 and flows back through the other length portions designated 46 in FIG. 4, to the outlet pipe 40 in which it is collected and channelled through the outlet opening 48. As already noted, it is highly desirable during circulation of the water through the sinuous conduit arrangement 20 that as much heat as possible be extracted from the rising flue or combustion gases 12 and transferred, by heat exchange, to the circulating water. To this end, the comparatively closed spaced apart fins 22 are appropriately mounted in spaced relation along the conduit length portions 44 and 46. As perhaps best illustrated in FIG. 3, the water-circulation conduits 20 and their cooperating fins 22 are within the generally rectangular opening bounded by walls 24, 26, 28 and 30 of the frame. At this point in the description it is convenient to note that the size of the rectangular opening bounded by the just referred to walls is in excess of the diameter, designated 50, of the pipe or conduit 52 through which heat exchanger 10 is in communication with the boiler 14, and also through which the rising flue or combustion gases 12 are channelled to the chimney 16 for discharge. This increase in size in the opening of the rectangular frame of heat exchanger 10 contributes to a desirable unimpeded flow in the combustion gases 12 through the heat exchanger 10. To adjust for the change in the diameter size of the conduits 52 at opposite ends, and also to accommodate for the change from a circular to a rectangular shape, conduits 52 are appropriately connected to additional conduit members 54 and 56 of progressively increasing dimension.

Figure 1:
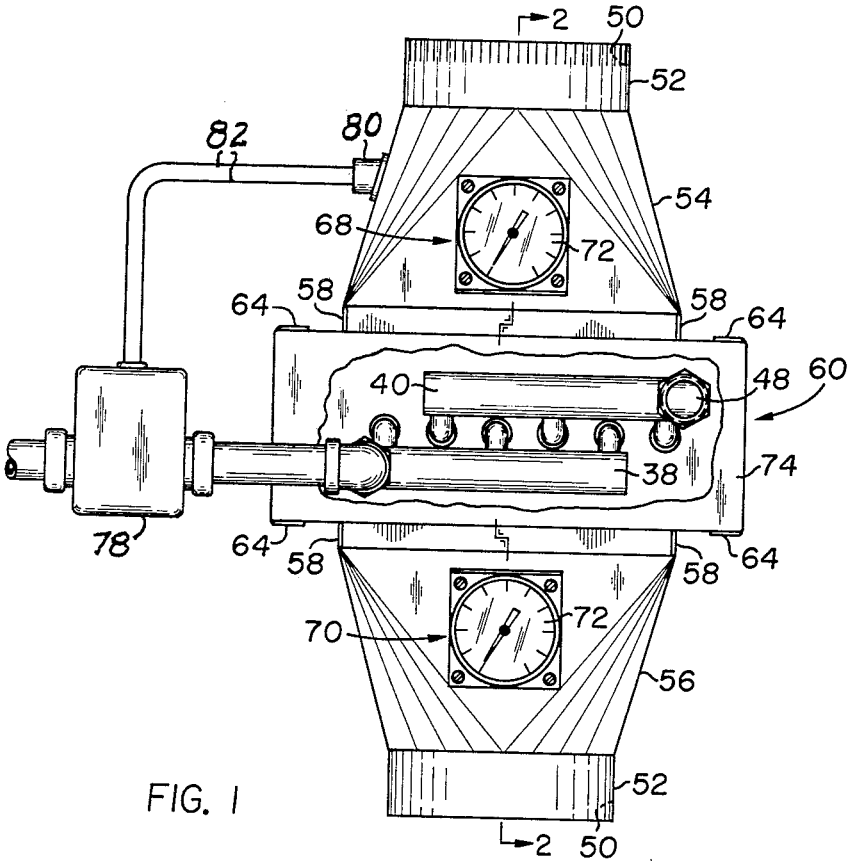
FIG. 1 is a front elevational view of the within improved heat exchanger with portions broken away to better illustrate structural features thereof.

At the bottom opening of member 54, and also at the corresponding upper opening of member 56, there is appropriately connected, as at the locations individually and collectively designated 58, an arrangement of walls forming an external generally rectangular housing 60. The heat exchanger 10, as just illustrated and described in connection with FIGS. 3, 4 and 5, is of a correspondingly rectangular shape as the rectangular shape bounded within housing 60, but of a slightly diminished size. As a result, heat exchanger 10 is adapted to be urged through sliding movements into and out of the housing 60 and, as a result, is thus readily positioned and removed in relation to the heat exchange station 18. To facilitate this sliding movement of the heat exchanger 10, which movement is very much like the sliding in and out of a drawer in a dresser, the rectangular frame of the heat exchanger 10 is provided with movement-guiding surfaces to facilitate this sliding movement. Thus, laterally extending along the upper and lower edges of the side walls 24 and 28 are surfaces individually and collectively designated 62 which, in the positioning of the heat exchanger 10 are supported by cooperating surfaces specifically designated 64 (see FIG. 1) of the external housing 60. In somewhat similar fashion, opposite end walls 26 and 30 have along the respective opposite upper and lower edges laterally extending surfaces 66 which, as is perhaps best illustrated in FIG. 2, in the operative position of the heat exchanger 10 at the heat exchange station 18 are supported on surfaces or walls 68 of housing 60.

To facilitate the positioning and removal of heat exchanger 10 in relation to the heat exchange station 18 by opposite direction sliding movement thereof within the housing 60, use is advantageously made of either one or the other of the horizontal pipes 38 and 40. Specifically, these pipes are available to be conveniently gripped by the user for either pulling the heat exchanger 10 out of the housing 60, or pushing it, in the opposite direction, when positioning it within such housing.

During insertion within the housing 60, surfaces 66 on the rear wall 26 are sized to function as stops against the rear wall of the housing 60, so as to minimize the possibility of damage to the pipe fixtures 36.

To monitor or supervise the efficiency with which heat is extracted from the rising combustion gases 12 at the heat exchange station 18, a preferred embodiment contemplates the use of thermostats 68 and 70 appropriately mounted in the conduit members 54 and 56, respectively. The temperatures recorded on the thermostats, as on the visible scales 72 thereof, would reveal, by comparison, the amount of heat extracted from the combustion gases, since thermostat 70 will register the temperature thereof entering into the heat exchange station 18 and the thermostat 68 the temperature of such gases exiting therefrom. Depending on what is observed, the user may be forewarned that the fins 22 are being clogged with soot and it is therefore necessary to remove the heat exchanger 10 for cleaning. Observation of the recorded temperatures might also indicate that adjustment is necessary in the operation of the pump (not shown) circulating the water through the conduits 20. Completing construction of the heat exchanger 10 is a closure 74 which fits over the front of the housing 60. Appropriate plumbing fixtures, as exemplified by fixture 76, project through appropriate openings in the closure 74 to complete the fluid connections to the pipes 38 and 40.

A pump 78 may be operationally interposed between the source of heat exchange fluid or water and the inlet pipe 38 for facilitating the flow of the fluid through the sinuous circulation conduits 20. A thermostat 80 mounted on the upper or exhaust conduit wall 54 and projecting its sensing element into the exhaust conduit and within the combustion gas flow path 12 may be electrically connected as by wires 82 to the pump 78 for controlling the operation thereof. Thus, the flow of water through the conduits 20 may be varied in accordance with the temperature of the exhaust gases sensed at the thermostat 80 to regulate the extraction of heat from the rising combustion gases 12.

From the foregoing description it should be readily appreciated that there has been described a compactly constructed heat exchanger 10 which through sliding movement, much like a drawer in a dresser, is readily positioned at and removed from a heat exchange station 18 established in a flue or combustion gas outlet. Although a preferred embodiment has herein been illustrated and described, a latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A heat exchanger adapted for facilitated positioning and removal in relation to a heat exchange station preparatory to extracting heat from combustion gases during the exiting flow thereof through an exit conduit, the said heat exchanger comprising four vertically oriented walls operatively arranged in facing relation to define an open rectangular frame of a selected size in excess of said exit conduit to contribute to unimpeded movement therethrough of said combustion gases, a sinuous arrangement of water-circulation conduits disposed in spanning relation between an opposing two of said walls for positioning said conduits transversely across said flow path of said combustion gases, movement-guiding surfaces extending laterally along opposite edges of each said wall for establishing contact with cooperating surfaces of said exit conduit of said combustion gases, whereby said heat exchanger is adapted to be urged through opposite direction sliding movement while supported by said established contact of said cooperating surfaces to thereby contribute to the facilitated positioning at and removal thereof from said heat exchange station, plural heat exchange fins supported transversely of and in spaced relation along said water-circulation conduits to contribute to maximizing the extent of heat extracted from said combustion gases, said spaces between adjacent fins being of an optimum nominal extent of approximately $\frac{3}{8}$ of an inch and effectively maintained free of any clogging material incident to the facilitated removal of said heat exchanger for periodic cleaning, the ends of said water-circulation conduits being arranged to project beyond said one supporting wall serving as the front of said frame, and at least one additional horizontally oriented conduit being connected to said projected ends to provide fluid communication therebetween, whereby said additional conduit also effectively serves as a handle for conveniently gripping said heat exchanger incident to its being urged through said sliding movements, the ends of said water-circulation conduits are arranged to also project beyond said other supporting wall serving as the rear of said frame, and said movement-guiding surfaces of said rear wall extend an appropriate distance in relation to said projected ends to serve as stops protecting said ends against damaging contact during the positioning of said heat exchanger at said heat exchange station, said exit conduit of said combustion gases having connected to openings thereof in facing relation to each other a corresponding facing pair of cooperatively outwardly diverging conduit members for enlarging the size of said flow path of said combustion gases and there is a rectangular housing connected in an interposed position between said flow path-enlarging conduit members for slidably receiving said heat exchanger, and a thermostat being operatively associated with each said flow path-enlarging conduit members, whereby a comparison of the temperatures recorded on said thermostats is effective in indicating the temperature drop in said combustion gases flowing through said heat exchange station.

* * * * *

UNITED STATES PATENT AND TRADEMARK OFFICE

CERTIFICATE OF CORRECTION

PATENT NO. : 4,215,741

DATED : August 5, 1980

INVENTOR(S) : Martin P. Averbuch et al.

It is certified that error appears in the above—identified patent and that said Letters Patent is hereby corrected as shown below:

Column 6, line 40 "cooperatively" should read --cooperating--.

Signed and Sealed this

*Twenty-eighth* Day of *October 1980*

[SEAL]

*Attest:*

SIDNEY A. DIAMOND

*Attesting Officer*

*Commissioner of Patents and Trademarks*